US007503813B1

(12) United States Patent
Osterhart

(10) Patent No.: US 7,503,813 B1
(45) Date of Patent: Mar. 17, 2009

(54) ELECTRICAL TERMINAL WITH CONTOURED CONTACT ELEMENT

(75) Inventor: Michael Paul Osterhart, Milford, MI (US)

(73) Assignee: Yazaki North America, Inc., Canton, MI (US)

( * ) Notice: Subject to any disclaimer, the term of this patent is extended or adjusted under 35 U.S.C. 154(b) by 75 days.

(21) Appl. No.: 11/798,792

(22) Filed: May 17, 2007

(51) Int. Cl.
*H01R 11/22* (2006.01)

(52) U.S. Cl. ..... 439/852

(58) Field of Classification Search ..... 439/851–852, 439/856–857, 862; 200/283
See application file for complete search history.

(56) References Cited

U.S. PATENT DOCUMENTS

| | | | | |
|---|---|---|---|---|
| 4,295,009 | A * | 10/1981 | Weidler | 439/862 |
| 5,083,936 | A * | 1/1992 | Yang | 439/441 |
| 5,112,254 | A | 5/1992 | Endo | |
| 5,562,501 | A | 10/1996 | Kinoshita et al. | |
| 5,630,738 | A | 5/1997 | Ito et al. | |
| 5,733,155 | A | 3/1998 | Sagawa | |
| 6,290,553 | B1 | 9/2001 | Sato et al. | |
| 6,293,833 | B1 | 9/2001 | Kamath | |
| 6,386,928 | B2 | 5/2002 | Kitamura | |
| 6,478,636 | B1 | 11/2002 | Makita et al. | |
| 6,547,608 | B2 | 4/2003 | Sato et al. | |
| 2006/0205288 | A1 * | 9/2006 | Chung | 439/862 |

* cited by examiner

*Primary Examiner*—Renee Luebke
*Assistant Examiner*—Larisa Tsukerman
(74) *Attorney, Agent, or Firm*—Daniel R. Edelbrock

(57) ABSTRACT

An electrical terminal has a frame with an inner spring element for making electrical contact. The spring element has a base section near a wire connect portion of the terminal and an elevated section extending from the base section toward a mating end of the terminal. A raised projection is formed between the base and elevated sections to strengthen the spring element where it bends. The projection is made by punching an indentation in adjacent lower surfaces of the base and elevated sections. The elevated section has an apex with a center contact strip bordered on each side by a recess in the elevated section to avoid a sudden increase in a mating terminal insertion force. A guide member on the frame blocks a mating terminal from being inserted under the elevated section. A support member on the frame underneath the elevated section prevents excessive deflection of the spring element.

14 Claims, 4 Drawing Sheets

ELECTRICAL TERMINAL WITH CONTOURED CONTACT ELEMENT

BACKGROUND OF THE INVENTION

1. Field of the Invention

The invention relates in general to electrical terminals and more particularly to an electrical terminal with an inner spring element having a contact surface for electrical connection with a mating terminal.

2. Discussion of Related Art

Typical female terminal designs use a front-hung inner spring element or arm. The pivot or bending area of the spring arm is located at an insertion end of the terminal, where a male terminal or blade is first received. Usually there is a point contact formed by a bump on the surface of the spring arm for electrically connecting with the male blade as the blade reaches full insertion. An example of this type of design is shown in U.S. Pat. No. 5,562,501. In general, the front-hung design yields a high ratio of scrap during the manufacturing process, causing higher material costs. An example of a rear-hung spring arm is disclosed in U.S. Pat. No. 6,386,928. The pivot or bending area of the spring arm is located closer to where the terminal is connected to an electrical conductor or wire, with a free end of the spring arm extending forward toward the insertion or mating end of the terminal. Rear-hung designs create less material scrap but often increase male terminal blade insertion forces.

The bump-style contact on the typical spring arm causes a spike in the male terminal blade insertion forces. However, eliminating the bump often decreases the quality of the electrical contact. The bump is sometimes replaced by a larger bulge in the contact surface to reduce insertion force spikes, but a smaller contact point or area produces a better and more reliable electrical connection by digging into the plating on the male terminal blade.

Consequently, a rear-hung spring arm that is particularly designed to reduce insertion forces and has a replacement feature for the bump that retains the quality of the electrical contact yet doesn't cause a spike in the insertion forces would seem to be beneficial to the art.

SUMMARY OF THE INVENTION

Accordingly, it is an object of this invention to provide an electrical terminal with a rear-hung contact spring element that gives a lower insertion force.

Another object of the invention is to reduce a spiked increase in the mating terminal insertion force as the mating terminal moves against the spring element.

A further object of the invention is to strengthen the spring element at an effective pivot point.

In carrying out this invention in the illustrative embodiment thereof, a female electrical terminal has a box-like frame with an insertion end for receiving a mating male terminal blade. The frame is joined to a wire connect portion at an opposite end. An inner spring element for making electrical contact with the blade extends from an underside of the frame near the wire connect portion in a direction towards the insertion end of the frame.

The spring element has a base section attached to the underside of the frame near the wire connect portion and an elevated section extending from the base section to a free end proximate the insertion end of the frame. The base section merges into a first segment of the elevated section. An indentation punched into lower surfaces of the base section and first segment forms a raised projection between the base section and the elevated section. The projection joins the base section with a second segment of the elevated section.

The second segment merges with a third segment at an apex of the spring element. A narrow, centrally-located contact strip passes over the apex. There are depressions in the second and third segments on each side of the contact strip.

The rear-hung spring element reduces scrap material during manufacture of the female terminal. The raised projection aligns the effective pivot region of the spring element with a mating axis of the male terminal blade and lifts the bending or pivot region closer to the mating axis, controlling and lessening the insertion force. The projection also strengthens the base section where it joins the elevated section by distributing the bending and stress forces along the length of the projection. The contact strip at the apex of the elevated section with the depressions on each side essentially creates a raised contact area in the center of the spring element that is actually not higher than planar upper surfaces of the second and third segments. This provides a smooth insertion force contour or profile and reduces the insertion force as compared with a raised bump-style contact. The narrowness of the strip formed by the depressions makes a better electrical connection with the male terminal blade.

BRIEF DESCRIPTION OF THE DRAWINGS

This invention, together with other objects, features, aspects and advantages thereof, will be more clearly understood from the following description, considered in conjunction with the accompanying drawings.

DETAILED DESCRIPTION OF THE ILLUSTRATED EMBODIMENT

Figure 1:
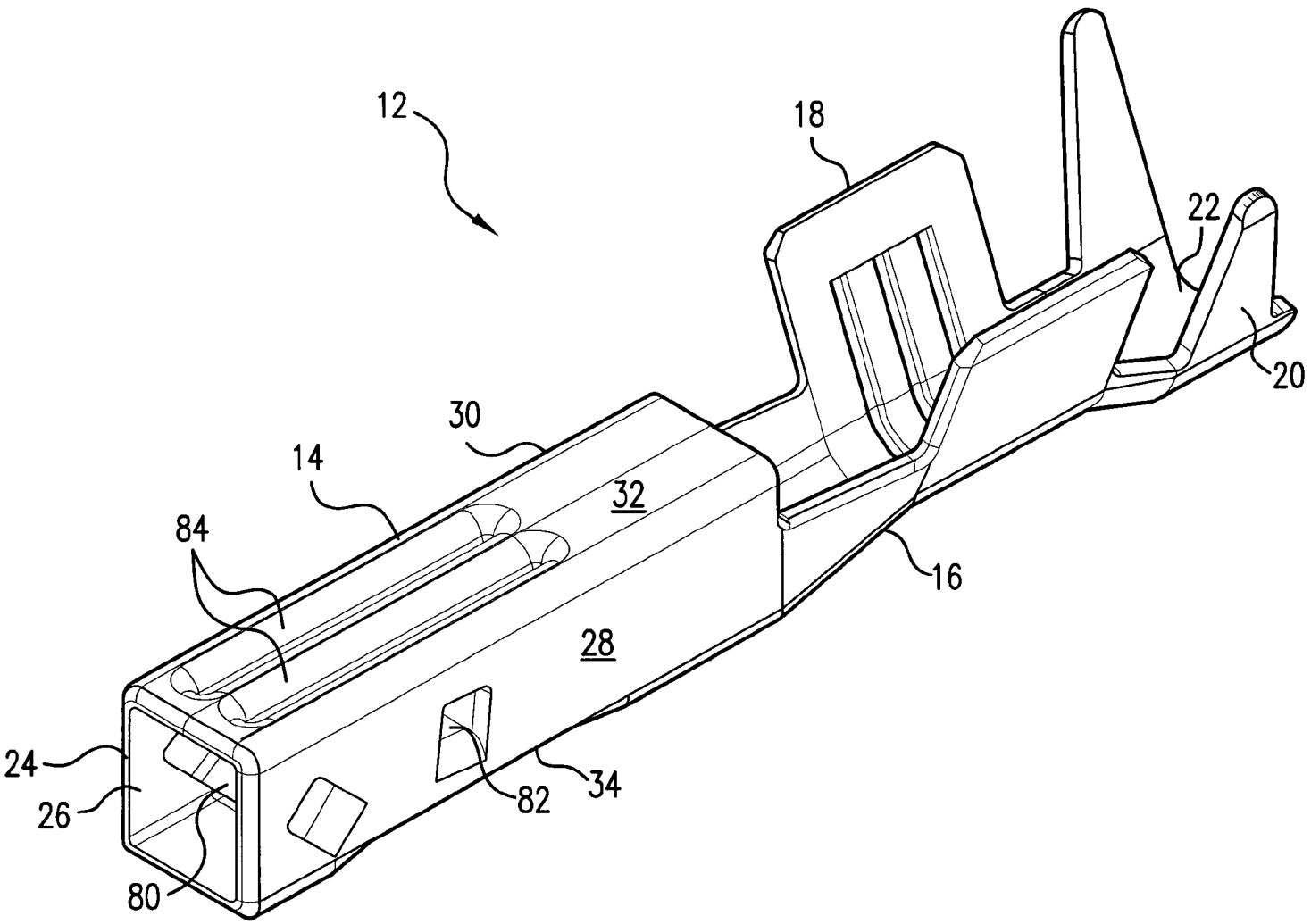
FIG. 1 is an enlarged perspective view of an electrical terminal according to the present invention.

Referring now to FIG. 1, an electrical terminal 12 according to the present invention is illustrated. The electrical terminal is stamped in one piece from an electrically conductive material such as a tin-plated copper alloy. The stamped blank is then formed into an outer, rectangular box-like frame 14. The frame 14 merges into a wire connect portion 16. The wire connect portion 16 has two sets of crimp tabs. A first set of inner crimp tabs 18 is for electrical connection to an end of an electrical wire (not shown) that has been stripped of its outer insulation jacket. A second set of outer crimp tabs 20 located at an end 22 of the terminal is used to mechanically secure the terminal 12 to the outer insulation jacket adjacent the stripped wire end. An opposite, insertion end 24 of the frame has an opening 26 for receiving a mating electrical terminal.

Figure 2:
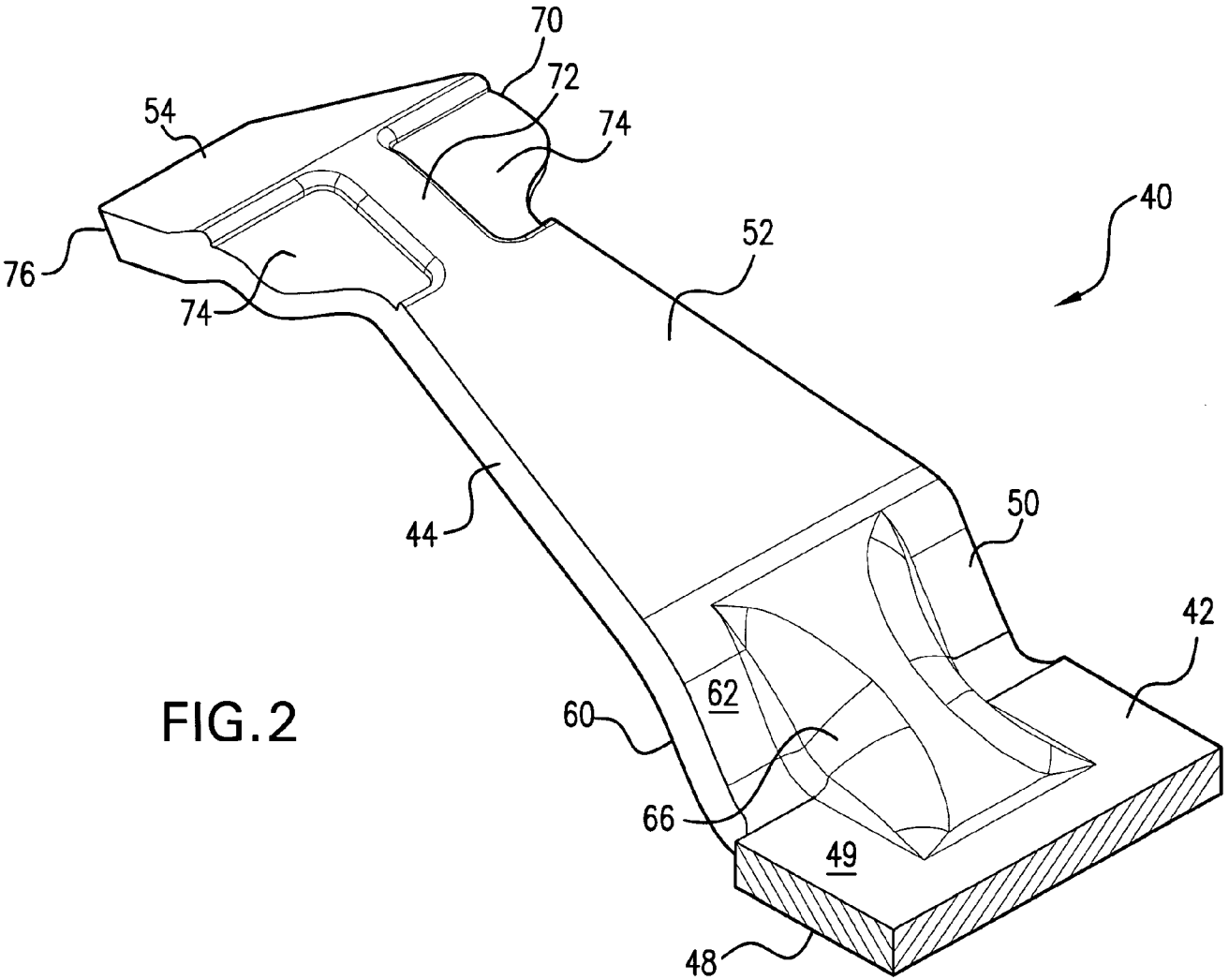
FIG. 2 is an enlarged perspective view of a spring element within the terminal of FIG. 1.
Figure 3:
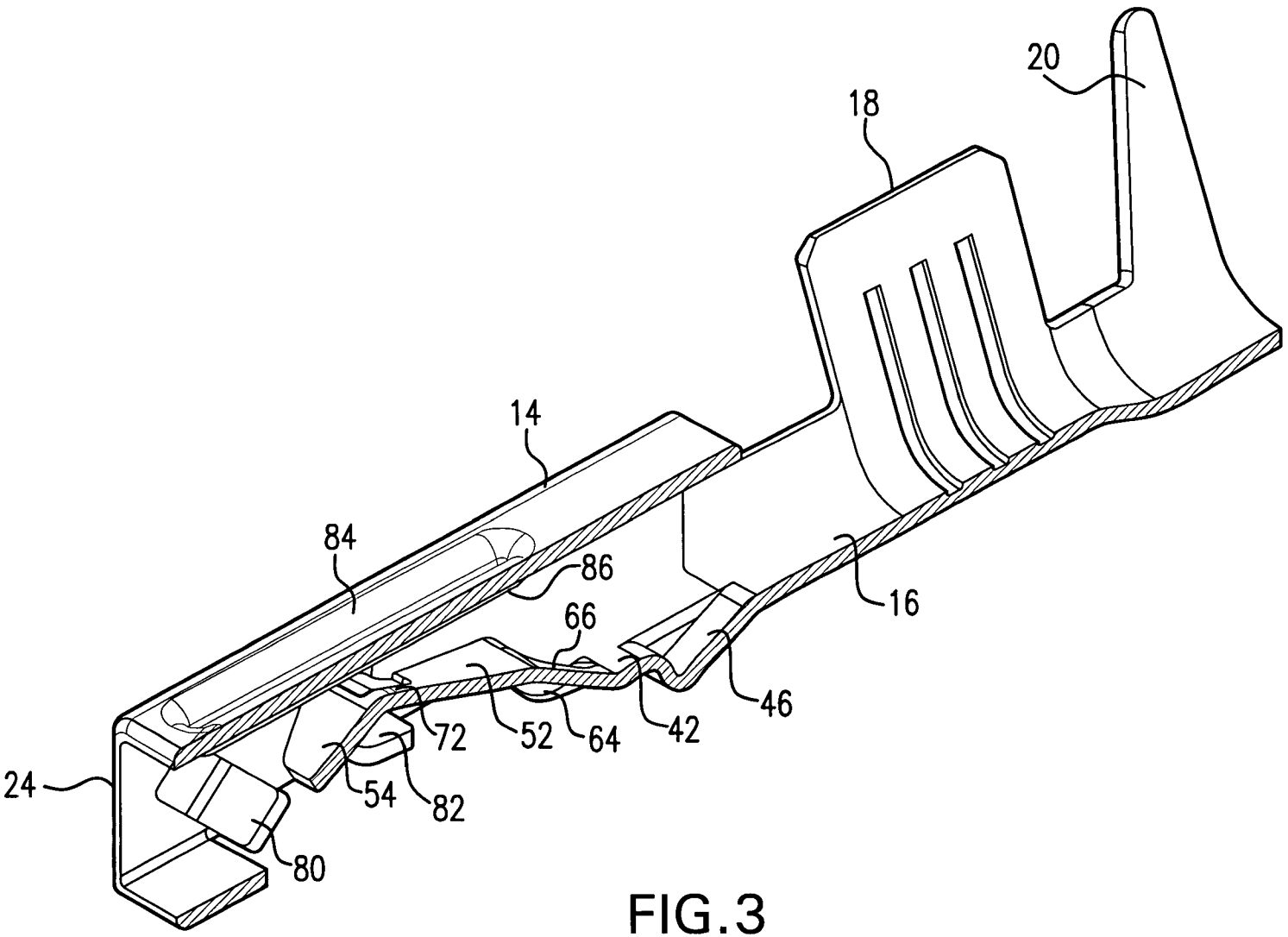
FIG. 3 is a sectional view taken at a centerline of the electrical terminal according to the present invention.

The box-like frame 14 has two opposite side walls 28 and 30, an upper side 32 (as oriented in the drawings) and an underside 34. As best shown in FIGS. 2 and 3, an inner spring arm or element 40 extends from the underside 34 toward the upper side 32. The spring element 40 has a level or flat base section 42 integral with the underside 34 of the frame near the wire-connect portion 16. An elevated section 44 of the spring element 40 gradually rises from the base section 42 toward the upper side 32 on slants or angles toward the insertion end 24 of the frame 14.

The base section 42 of the spring element 40 is integrally linked with an orienting feature 46 in the form of a downward protruding, partially v-shaped bend or bump that is also integral with the wire connect portion 16 at an opposite end. The orienting feature 46 assures that the terminal 12 is inserted in the correct orientation into a terminal accommodating chamber within a connector housing (not shown). A channel in the housing joined to the accommodating chamber on a particular edge would receive the orienting feature as the terminal is inserted into the chamber. The base section 42 and orienting feature 46 are immediately adjacent each other and aligned along the underside 34 of the frame 14. Opposite the orienting feature 46, the base section 42 merges into the elevated section 44. The base section has a lower or bottom surface 48 and a top surface 49.

The elevated section 44 has three differently inclined or slanted successive segments. A first segment 50 rises at an angle from the base section 42. A second segment 52 is approximately twice as long as the first segment 50 and rises at a smaller or shallower angle relative to the underside 34 of the frame 14. A third, shorter segment 54 is bent down at an angle back towards the underside 34 of the frame 14 at a relatively short distance inward from the opening 26 in the insertion end 24 of the frame.

The first segment 50 of the elevated section 44 of the spring arm 40 has a lower surface 60 and an upper surface 62. The lower surface 60 and the bottom surface 48 of the base section 42 have an indentation 64 that forms a raised projection 66 jutting from the upper surface 62 of the first segment 50 and the top surface 49 of the base section 42. The raised projection 66 is formed in center locations of the base section 42 and the first segment 50, and in profile (FIG. 4) resembles a slanted or inclined ramp or bridge-like transition between the level base section 42 and the second segment 52 of the elevated section 44. The indentation 64 forms the raised projection 66 as the indentation is punched into the base section 42 and the first segment 50. The indentation/projection strengthens the spring element 40 near the base section 42 and more evenly distributes the stress across the spring element.

The second segment 52 of the elevated section 44 curves into the down-turned third segment 54, forming a summit or apex 70 of the spring element 40. The apex 70 has a narrow, longitudinal, centrally located electrical contact strip or area 72 formed by recesses or depressions 74 in the segments 52 and 54 around the apex 70 on each side of the contact area 72. The apex 70 and recesses 74 effectively provide a raised contact area without actually raising the contact area 72 above top planar surfaces of the second and third segments of the spring element. Other patterns could be used to provide the contact area bordered by depressions. For example, there could be two contact areas, one at each side of the apex 70 with a central depression between them. The intent is to provide a contact area that is higher than its immediate surrounding surfaces but in fact is not actually raised above the main planar surfaces of the second and third spring element segments.

The second segment 52 narrows or tapers toward the apex 70 and then widens again as it joins the third segment 54. The tapered shape distributes strain over a larger area of the spring element, keeping contact forces with a mating male terminal consistent and relaxing tolerance requirements for the gap between the spring element 40 and the upper side 32 of the frame. The third segment 54 tapers from the second segment 52 to a free end 76 of the spring element 40.

The side walls 28 and 30 of the frame 14 each include a substantially flat guide member 80 and a substantially flat support member 82 cut out from the walls on three edges and bent into an interior of the frame. The guide member 80 is located adjacent the opening 26 at the insertion end 24 of the frame and is inclined to deflect the mating terminal upward so it is prevented from being inserted under the spring element 40. The guide member 80 protects the spring element 40 and guides the male terminal as it is inserted into the female terminal 12. Since the guide member 80 is located at the insertion end 24 of the frame 14, it also provides an alternate electrical continuity check location if needed when the terminal 12 is mounted in an electrical connector terminal accommodating chamber.

The support member 82 is located along the side wall adjacent the second segment 52 of the elevated section 44 of the spring element 40 and extends beneath the spring element to prevent it from being bent excessively downward by the mating terminal. In other words, the support member 82 makes certain the spring element 40 won't be over-stressed or over-deflected, so it won't exceed an elastic limit. It also assures that minimum contact force between the spring element 40 and male terminal is maintained.

Longitudinal, parallel depressions 84 in an outer surface of the upper side 32 of the frame 14 form parallel press members 86 in the interior of the frame. The press members 86 position the mating terminal at the predetermined or correct height within the frame, stabilize the mating terminal, and press the mating terminal against the contact area 72 of the spring element 40.

Figure 4:
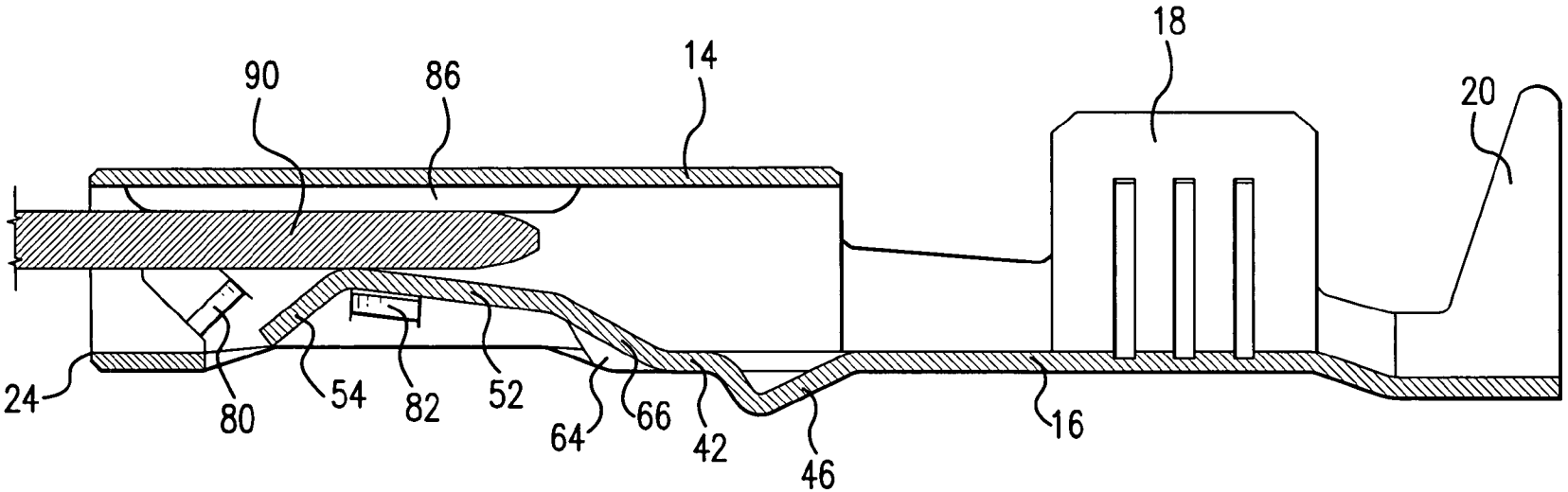
FIG. 4 is a sectional side view of the electrical terminal according to the present invention in combination with a male terminal blade.

The functions of the guide member 80, the support member 82 and the press members 86 are more clearly illustrated in FIG. 4, which includes a representation of a male terminal or blade 90, made from an electrically conductive material such as tin-plated brass, for electrically mating with the contoured spring element 40 within the female terminal 12. The contact area 72 at the apex 70 of the spring element 40 provides a smooth insertion force profile and a lower overall insertion force than is typical in the art. There is no jump in the insertion force as there would be from a flat surface of the spring element to a standard bump. The narrowness of the contact area 72 allows it to better dig into the plating on the male terminal 90, providing a more effective, reliable electrical connection.

The raised projection 66 strengthens the base section 42 of the spring element 40 where it meets the elevated section 44 and brings an effective pivot line of the spring element 40 closer to an axis of the male terminal 90, helping to control and minimize insertion forces. The male terminal blade is not pinched against the upper side 32 of the frame 14 as much as is typical in rear-hung terminals.

Since minor changes and modifications varied to fit particular operating requirements and environments will be understood by those skilled in the art, this invention is not considered limited to the specific examples chosen for purposes of illustration. The invention is meant to include all changes and modifications which do not constitute a departure from the true spirit and scope of this invention as claimed in the following claims and as represented by reasonable equivalents to the claimed elements.

What is claimed is:

1. An electrical terminal comprising:

a mating end and a wire connect portion;

a spring element extending between the wire connect portion and the mating end of the terminal, the spring element having an elevated section with first, second and third successive segments; and the spring element having an apex located where the second and third segments meet, the apex being configured as a contact strip bordered by recesses in a surface of the spring element on each side of the contact strip, the contact strip and recesses extending over the apex along the second and third segments, the second segment tapering toward the apex and the recesses widening as the recesses extend over the apex.

2. The terminal of claim 1 wherein the spring element further comprises a base section joined to the elevated section, and a raised projection between the base and elevated sections.

3. The terminal of claim 2 wherein the raised projection is formed in the first segment of the elevated section and extends between the base section and second segment of the elevated section.

4. An electrical terminal comprising:

an outer frame having a mating terminal insertion end;

a wire connect portion at an opposite end of the terminal from the mating terminal insertion end of the frame, a spring arm having an elevated section with at least first and second consecutive, inclined segments, the first segment rising from a base section joined to the frame adjacent the wire connect portion; and a raised projection in the first segment between the base section and the second segment, the raised projection providing a ramped transition from the base section over the first segment to the second segment of the spring arm, the raised projection being formed by a punched indentation in lower surfaces of the base section and the first segment of the elevated section.

5. The electrical terminal of claim 4 wherein the second segment of the elevated section extends at lesser incline from the first segment.

6. The electrical terminal of claim 5 further comprising a third segment of the elevated section extending back toward an underside of the frame, wherein an apex of the spring arm is formed where the second segment joins the third segment.

7. The electrical terminal of claim 6 wherein a contact area of the spring arm extends over the apex, and there are recesses in the spring arm on each side of the contact area to reduce a width of the contact area.

8. The electrical terminal of claim 7 wherein the second segment tapers toward the apex and the recesses widen as the recesses extend over the apex.

9. An electrical terminal comprising:

an outer frame joined to a wire connect portion with means for attaching the frame to an electrical wire, the frame having an insertion end for receiving a mating electrical terminal; and an inner spring element, the spring element having a base section extending from the frame adjacent the wire connect portion, and an elevated section rising from the base section toward the insertion end of the frame, the elevated section having an apex consisting of a narrow center electrical contact area formed by depressions in the apex located on each side of the contact area, a first segment of the elevated section and the base section having lower surfaces with an indentation forming a raised projection between the base section and elevated section to strengthen the spring element near the base section and move a pivot axis of the spring element closer to the mating electrical terminal.

10. The electrical terminal of claim 9 wherein the raised projection forms a ramp from the base section over the first segment to a second segment of the elevated section.

11. The electrical terminal of claim 9 further comprising a terminal orienting feature aligned with the base section and protruding from the frame between the base section and wire connect portion.

12. The electrical terminal of claim 9 further comprising at least one guide member protruding from a side of the frame near the insertion end for preventing a mating terminal from being inserted under the spring element.

13. The electrical terminal of claim 9 further comprising at least one support member protruding from a side of the frame to a location beneath the elevated section of the spring element to prevent excessive deflection of the spring element.

14. The electrical terminal of claim 9 further comprising at least one press member protruding from an upper side of the frame to position a mating terminal at, a predetermined height over the spring element.

* * * * *